US006394469B1

(12) United States Patent
Borel

(10) Patent No.: US 6,394,469 B1
(45) **Date of Patent: *May 28, 2002**

(54) IN-LINE ROLLER SKATE PROVIDED WITH AN INTERNAL SUPPORT FOR A USER'S FOOT

(75) Inventor: Rene Borel, Les Pres Grenier (FR)

(73) Assignee: Salomon S.A., Metz-Tessy (FR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/115,550

(22) Filed: Jul. 15, 1998

(30) Foreign Application Priority Data

Jul. 16, 1997 (FR) ..... 97 09331

(51) Int. Cl.[7] ..... A63C 17/06
(52) U.S. Cl. ..... 280/11.225; 36/117.5
(58) Field of Search ..... 280/7.13, 11.19, 280/11.28, 11.3, 11.221, 11.231, 11.233, 11.225; 36/28, 34 R, 37, 88, 92, 93, 104, 115, 117.5, 172

(56) References Cited

U.S. PATENT DOCUMENTS

| | | | | | |
|---|---|---|---|---|---|
| 2,113,862 | A | * | 4/1938 | Siffert | 280/11.22 |
| 3,387,852 | A | * | 6/1968 | De Sarro | 280/11.22 |
| 3,526,976 | A | * | 9/1970 | Jacobs | 280/7.13 |
| 3,984,926 | A | * | 10/1976 | Calderon | 36/37 |
| 4,058,324 | A | * | 11/1977 | Dallaire | 280/11.22 |
| 4,928,982 | A | * | 5/1990 | Logan | 280/11.22 |
| 4,955,147 | A | * | 9/1990 | Bos | 36/28 |
| 5,077,915 | A | * | 1/1992 | Gross | 36/28 |
| 5,090,139 | A | | 2/1992 | Germann | 36/117 |
| 5,317,819 | A | * | 6/1994 | Ellis, III | 36/88 |
| 5,331,752 | A | * | 7/1994 | Johnson et al. | 280/11.22 |
| 5,413,380 | A | * | 5/1995 | Fernandez | 280/11.19 |
| 5,437,111 | A | * | 8/1995 | Kousaka et al. | 36/34 R |
| 5,645,288 | A | * | 7/1997 | Lu | 280/11.22 |
| 5,662,338 | A | * | 9/1997 | Steinhauser, Jr. | 280/11.3 |
| 5,732,481 | A | * | 3/1998 | Farhad | 36/37 |
| 5,887,898 | A | * | 3/1999 | Petrosino | 36/115 |
| 6,041,523 | A | * | 3/2000 | Deloreia | 36/71 |
| 6,145,852 | A | * | 11/2000 | Bain | 280/11.22 |
| 6,164,669 | A | * | 12/2000 | Svensson | 280/11.3 |

FOREIGN PATENT DOCUMENTS

| | | | | |
|---|---|---|---|---|
| EP | 0619960 | | 10/1994 | |
| FR | 2566672 | * | 1/1986 | 280/11.22 |
| JP | 50/81125 | * | 1/1977 | 280/11.23 |
| WO | WO 97/18019 | | 5/1997 | |

* cited by examiner

*Primary Examiner*—Frank Vanaman
(74) *Attorney, Agent, or Firm*—Greenblum & Bernstein, P.L.C.

(57) ABSTRACT

An in-line roller skate having a boot and a chassis, the chassis having a longitudinal bottom part on which are arranged a plurality of wheels equipped with rotating axles aligned along a reference plane, which is overlaid by a plate adapted to receive the sole of the boot, wherein the boot has an internal wedging element arranged at the bottom of the boot, in order to define the angular position α of at least part of the foot relative to the plane by producing a height difference between the support plane of the heel of the foot and the plantar support plane at the level of the metatarsi.

16 Claims, 3 Drawing Sheets

20
19
7
1
2
21
4
4a
4b
3
4
8
11
11
8
10
12
12
12
6
12
6
6
12
6

IN-LINE ROLLER SKATE PROVIDED WITH AN INTERNAL SUPPORT FOR A USER'S FOOT

BACKGROUND OF THE INVENTION

1. Field of the Invention

The present invention relates to an in-line roller skate. More particularly, the invention has an advantageous application in the practice of so-called "aggressive" skating. However, the invention is not limited to this particular inline roller skating discipline and can be used on skates for hockey, racing, or even those intended for recreational practice (also called "fitness" skating).

2. Description of Background and Material Information

In a known way, a skate is constituted by a chassis comprising a longitudinal bottom part, generally formed by parallel lateral walls, on which the wheels are arranged; this bottom part is overlaid by a plate intended for the fastening of the sole of a boot.

The evolution of the art in the field of in-line roller skates has provided solutions in response to needs that have arisen from the practice, such as the need to allow a certain number of adjustments, for example the adjustment of the angular position of the chassis relative to the axis of the boot.

In practice, it has been determined that the skater's foot should not be positioned inside the boot on a flat-soled surface; on the contrary, the heel is preferably raised relative to the rest of the foot, which has the effect of improving the maneuverability of the skate. For this reason, it is known to use chassis having a receiving plate formed by a part for the front of the foot and a heel part that are vertically offset, the heel part being raised relative to the rear part. As a general rule, the greater the offset, the better the maneuverability.

In order to give the skater great maneuverability in his skates, the height differences (offsets) can vary between 11 and 20 mm, or even 25 mm.

The solution of offsetting the plate of the chassis has some drawbacks. In particular, in the practice of "aggressive" skating, the lower surface of the plate serves as a surface for sliding along various supports such as rails, bars or curbs. A height difference between a front part and a rear part of the plate causes problems in finding equilibrium during sliding.

Another drawback arises from the fact that it is necessary to provide for the use of a chassis having an offset specific to a boot type and to the discipline practiced. Thus, it is difficult to find a standard chassis which, for example, can adapt to a wide variety of boots or can be used in different disciplines.

Another problem known in certain disciplines, like the practice of "aggressive" or other types of skating, relates to the lack of shock absorption during the many impacts sustained by skaters in the area of the heels, as in landing on the ground after jumps, for example. It is, of course, known to arrange shock absorbing elements between the chassis and the shell of the boot, but this also has drawbacks. In particular, it is possible to observe a substantial loss of energy in the forces transmitted by the skater between the shell of the boot and the chassis supporting the wheels, as well as a loss in the return of information from the ground to the skater's foot. The linkage between the shell and the chassis is also more difficult to obtain and can cause stability problems. It is also possible to observe a poorer maneuverability of the skates due to the positioning of the shock absorbing interface between the two basic elements of the skate.

SUMMARY OF THE INVENTION

Therefore, one of the objects of the invention is to provide a solution which makes it possible to meet the needs linked to the height difference between the support of the heel of the foot and the support at the level of the metatarsi in order to retain the maneuverability of the skate, while having a chassis of simplified design adapted to specific types of practices such as "aggressive" skating. More precisely, a chassis adapted to the practice of "aggressive" skating is a chassis having an appropriate sliding surface without any height offset at the level of its plate. According to the object sought, a chassis of this type also has the advantage of lending itself more easily to standardization and interchangeability.

Another object of the invention is to provide a skate that offers both a satisfactory solution to the raising of the heel, as mentioned above, while providing appropriate shock absorption without an excessive loss of transmission of forces between the foot and the wheels, and while providing the skate with good maneuverability.

To this end, the invention relates to an in-line roller skate having a boot and a chassis, the chassis having a longitudinal bottom part on which are arranged a plurality of wheels equipped with rotating axles aligned along a reference plane, which bottom part is overlaid by a plate adapted to receive the sole of the boot, wherein the boot has an internal wedging element arranged at the bottom of the boot in order to define the angular position of at least part of the foot relative to the reference plane, by producing a height difference between the support plane of the heel of the foot and the plantar support plane in the area of the metatarsi.

According to a complementary characteristic, the internal wedging element constitutes a shock absorbing element having an elastically deformable material.

BRIEF DESCRIPTION OF DRAWINGS

The present invention also relates to the characteristics which will emerge from the following description, which should be considered separately or in any of their possible technical combinations. This description, given as a non-limiting example, is intended to provide a better understanding of how the invention may be embodied, with reference to the appended drawings, in which.

DETAILED DESCRIPTION OF THE INVENTION

Figure 1:
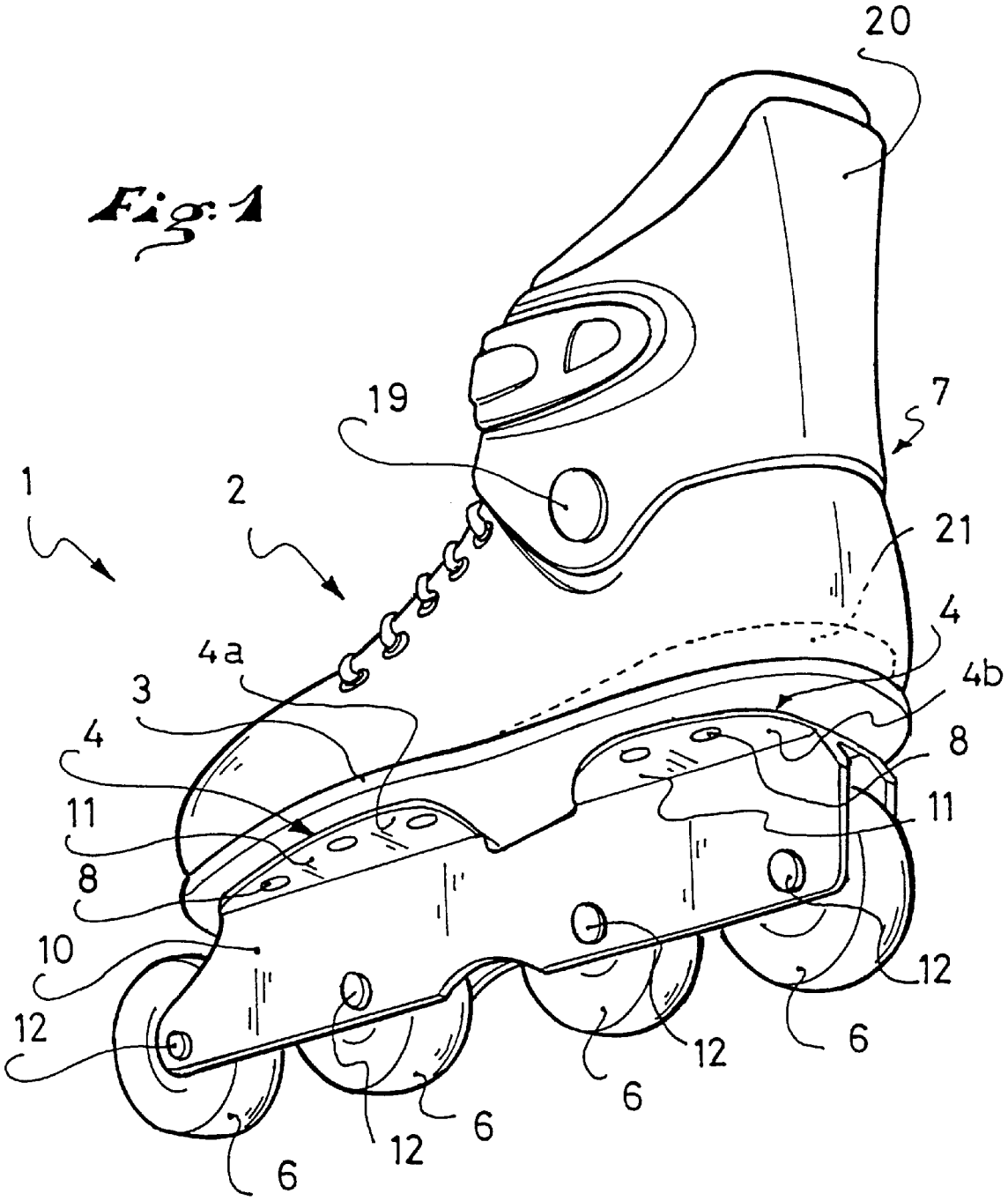
FIG. 1 is a view in perspective of an in-line roller skate, provided as an example, and an associated boot according to the invention.

The in-line roller skate 1, designated in its entirety, is represented in FIG. 1 and is more particularly intended for the practice of so-called "aggressive" or "urban" skating, or for the practice of hockey.

It is constituted by a chassis 5 having a longitudinal bottom-part on which are arranged a plurality of wheels 6, which is overlaid by a plate 4 adapted for the fastening of a boot 2 formed by an upper 7, whose lower part covering the foot, preferably constituted by a shell of more or less rigid synthetic material, integrates an external sole 3 and is extended by an upper part 20 in the direction of a skater's ankle, and for example by a collar 20 articulated on pins 19.

In a known way, the sole 3 of the boot 2 is affixed to the chassis 5 forming the upper horizontal plate 4 onto which this sole 3 is fastened by means of fasteners, in this case screws 8 passing through the plate 4 in order to be screwed into the lateral edges of the sole 3. The fastening, arranged laterally, relative to a central fastening has an advantage in that it is possible to use more flexible materials for the boot part, thus ensuring comfort and coverage while retaining a good quality of transmission with the chassis.

The longitudinal bottom part of the chassis 5, perpendicular to the plate 4, is constituted, for example, by two lateral vertical flanges 10, parallel to one another and arranged on either side of the longitudinal axis of this chassis.

The lateral flanges 10 respectively extend into two upper parts one in the front 4*a,* the other in the rear 4*b*. The front 4*a* and rear 4*b* parts of the plate have a sliding surface 11, forming a return directed toward the outside, or transversely outwardly relative to opposite lateral sides of the chassis, the sliding surface being aligned along a sliding plane P1 substantially parallel to the axles 12 of the wheels 6. Thus, the chassis has no height offset, which improves the practice of "aggressive" skating when the skater uses the front and rear parts of the plate as sliding surfaces.

The lateral vertical flanges 10, with the sole 3 of the boot 2, generally define an inverted U between the flanges of which a plurality of wheels 6, for example four in number, are arranged by means of transverse journal axles 12 affixed to the chassis 4, so as to constitute a rolling train. The journal axles 12 are generally aligned with one another horizontally along a plane ( ), which is substantially parallel to the plane of the ground (not represented).

As shown in the figures, the plate 4 is horizontal and extends substantially parallel to the journal axles 12 of the wheels 6 so as to provide a relatively flat sliding surface. Preferably, the plate 4 can also be partially integrated into the sole 3 of the boot, in housings 3*a* associated with the latter, in order to constitute, along with the lower surface of the latter, the widest possible sliding surface.

Figure 2:
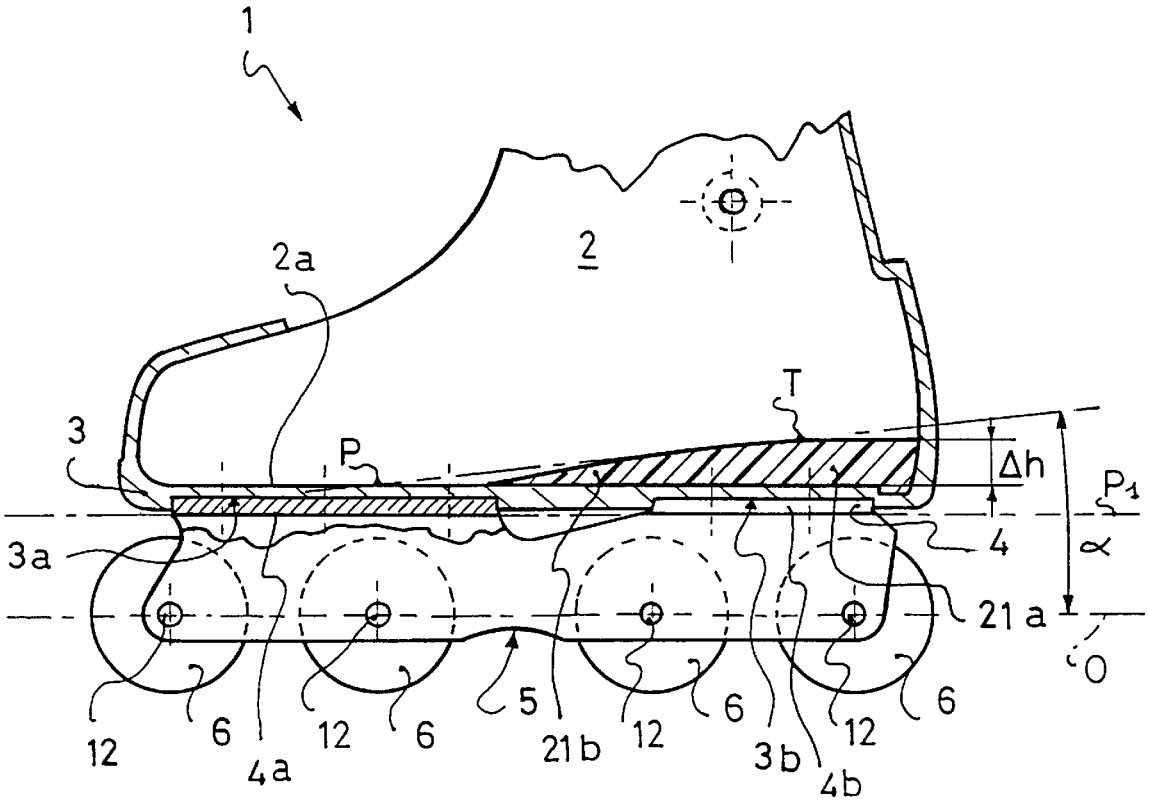
FIG. 2 is a schematic view according to FIG. 1 showing in cross section an internal wedging element according to the invention.
Figure 3:
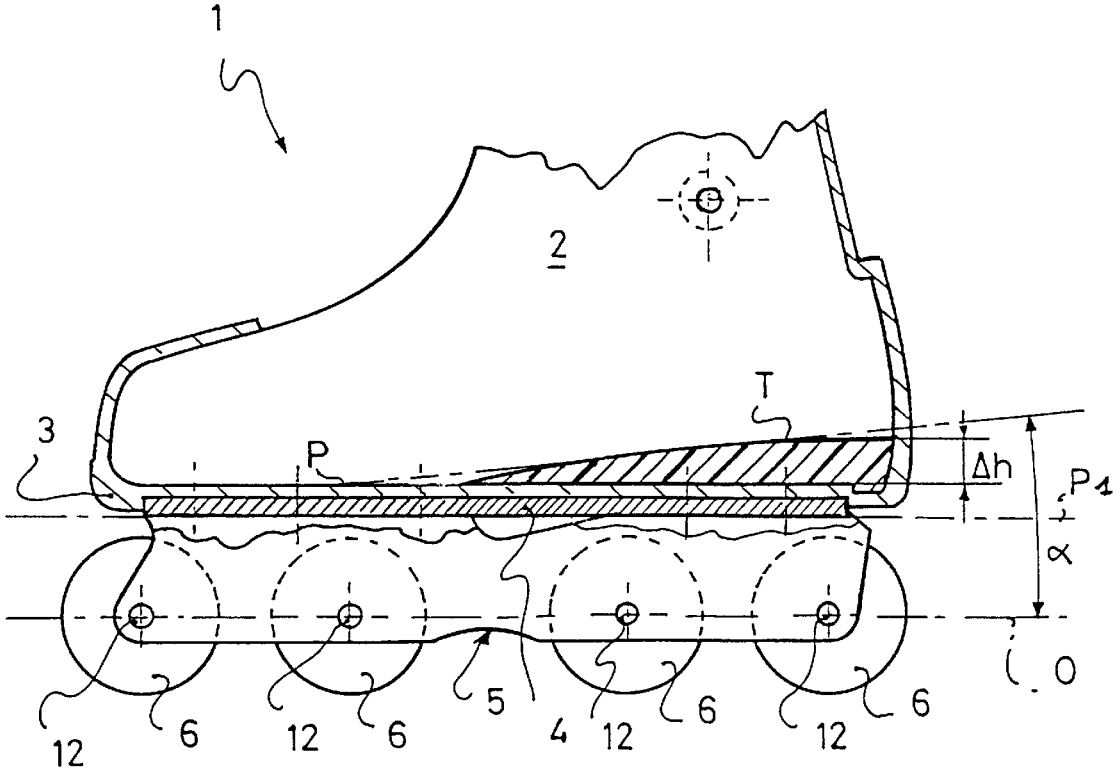
FIG. 3 is a schematic view similar to FIG. 2 according to an alternative embodiment of the invention.

According to the invention, the boot 2 has an internal wedging element 21 made of elastically deformable material and arranged on the flat bottom, or lower internal surface, 2*a* of the boot 2, so as to constitute both a means for absorbing shocks and a means for adjusting the angular position $\alpha$ of a skater's foot relative to the ground, by inducing a height difference $\Delta h$ between the support plane of the heel T of the foot and its plantar support plane P at the level of the metatarsi. A wedging element 21 of this type can, of course, be arranged above or below an insole (not represented in the drawing). As shown in FIGS. 2 and 3, the lower internal surface 2*a* of the boot includes front and rear lower internal surfaces which are co-planar, the wedging element being supported at least partially, but primarily, upon this rear lower internal surface.

According to the exemplary embodiment in FIG. 2, the internal wedging element 21 has a rear part 21*a* with a substantially constant thickness $\Delta h$, which is adapted to receive the heel, this rear part 21*a* becoming thinner toward the front and extending to the level of the plantar arch, where it ends in a part 21*b* that is substantially wedge-shaped. Thus, this wedging element has an anatomical shape and is made of a shock absorbing and elastically deformable material. Preferably, it is attached to the bottom 2*a* of the boot 2 in a removable way, in order to allow it to be interchangeable with wedging elements of different heights, providing a different $\Delta h$ which can vary, in particular, from 18 to 25 mm. Of course, it could also be embodied so as to be fixed. The internal wedging element has the effect of positioning at least part of the foot in an inclined configuration, which improves the maneuverability of the skate. In particular, the heel part is brought to an angular position (alpha) relative to the reference plane ( ) passing through the axles of the wheels.

According to a variant of embodiment (not represented), the internal wedging element 21 is a piece of elastically deformable material different from that which forms the external sole 3 of the boot 2 and produced simultaneously with this external sole 3 by duplicate molding, during the same operation.

According to an advantageous embodiment, the wedging element 21 can be constituted by a closed-cell foam, so that it can be machined by removing material and adapted to the height desired by the user.

In another embodiment, represented in FIG. 3, the plate 4 of the chassis is formed of a single lateral part of each side of the vertical flanges 10, forming an external return that extends continuously from the front to the back of the skate. In this case, the sliding surface forms a continuous flat surface in the sliding plane P1. Therefore, a surface of this type is better adapted to the practice of "aggressive" skating than a traditional chassis.

Preferably, the elastically deformable material constituting the wedging element 21 in the form of a wedge is a polyurethane or a polyethylene.

Tests have demonstrated that a polyurethane with a density of 0.38 provides excellent results.

However, it is to be understood that it is entirely possible to consider other types of materials, provided that they are elastically deformable in such a way as to effectively absorb the shocks due to the practice of these disciplines.

The instant application is based upon French Patent Application No. 97 09331, filed on Jul. 16, 1997, the disclosure of which is hereby expressly incorporated by reference thereto in its entirety, and the priority of which is hereby claimed under 35 USC 119.

What is claimed is:

1. An in-line roller skate comprising:

a chassis having a longitudinally extending lower portion, a plurality of wheels affixed to said chassis for rotation about respective transverse axes, said axes extending along a reference plane, said chassis further having an upper portion, said upper portion comprising a front part and a rear part, said front and rear parts having lower surface portions aligned along a sliding plane, said lower surface portions of said front and rear parts extending transversely outwardly relative to opposite lateral sides of said lower portion of said chassis for facilitating use of said lower surface portions as sliding surfaces during use of the skate, said sliding plane being substantially parallel to said reference plane; and a boot supported upon said upper portion of said chassis, said boot including a front lower internal surface and a rear lower internal surface, whereas said front lower internal surface and said rear lower internal surface are co-planar, said boot further comprising an internal heel-raising and shock-absorbing element supported by said front and rear lower internal surfaces, said internal element being adapted to define an angular position for the foot relative to said reference plane by raising a heel of a user's foot above a plantar support plane in an area of a metatarsus of the foot, said internal element comprising an elastically deformable material.

2. An in-line roller skate according to claim 1, wherein:

said internal element is removably attached to said lower internal surface of the boot in order to allow said internal element to be interchangeable with internal elements of different heights.

3. An in-line roller skate according to claim 1, wherein:

said boot further comprising an external sole made of a determinate material; and said elastically deformable material of said internal wedging element is different from said determinate material of said external sole, said internal wedging element and said external sole being produced simultaneously by duplicate molding, during a common operation.

4. An in-line roller skate according to claim 1, wherein:

said elastically deformable material of said internal element is a polyurethane.

5. An in-line roller skate according to claim 1, wherein:

said front part and said rear part of said upper portion of said chassis are separate and longitudinally spaced apart, said rear part adapted to be positioned below a heel of the user's foot and said front part being adapted to be positioned below a metatarsus of the user's foot.

6. An in-line roller skate according to claim 1, wherein:

said longitudinally extending lower portion of said chassis comprises a pair of laterally offset vertical flanges, said plurality of wheels being arranged between said flanges;

said front and rear parts of said upper portion of said chassis comprise a single lateral part on each respective side of said vertical flanges, each of said lateral parts forming an external return extending continuously from a front portion to a rear portion of the skate;

said lateral parts of said front and rear parts of said upper portion of said chassis further having respective continuous flat sliding surfaces, said sliding surfaces constituting said lower surfaces of said front and rear parts of said upper portion of said chassis.

7. An in-line roller skate according to claim 1, wherein:

said boot comprises an external sole; and said upper portion of said chassis is at least partially integrated into said external sole of said boot.

8. An in-line roller skate according to claim 1, wherein:

said boot comprises an external sole, said external sole having a downwardly facing housing; and said upper portion of said chassis is at least partially positioned within said housing of said external sole of said boot.

9. An in-line roller skate according to claim 1, wherein:

said internal element is made of polyethylene.

10. An in-line roller skate according to claim 1, wherein:

said internal element is made of a closed cell form.

11. An in-line roller skate according to claim 1, wherein:

said boot comprises an external sole and at least one downwardly facing housing; and said front and rear parts of said upper portion of said chassis are at least partially fixed within said at least one downwardly facing housing of said external sole of said boot.

12. An in-line roller skate comprising:

a chassis having a longitudinally extending lower portion, a plurality of wheels affixed to said chassis for rotation about respective transverse axes, said axes extending along a reference plane, said chassis further having an upper portion, said upper portion comprising a front part and a rear part;

a boot supported upon said upper portion of said chassis, said boot including a front lower internal surface and a rear lower internal surface, wherein said front and rear internal surfaces are co-planar;

at least one front sliding surface and one rear sliding surface, wherein said at least one front and rear sliding surface are co-planar and parallel to said reference plane; and an internal heel-raising and shock-absorbing element supported by said rear lower internal surface, said internal element being adapted to define and angular posiiton for the foot relative to siad reference plane by raising a heel of a user's foot, said internal element comprising an elastically deformable material.

13. An in-line roller skate according to claim 12, wherein:

said internal element is supported on said rear lower internal surface of the boot in order to allow said internal element to be interchangeable with internal elements of different heights.

14. An in-line roller skate according to claim 12, wherein:

said elastically deformable material of said internal element is a polyurethane.

15. An in-line roller skate according to claim 12, wherein:

said internal element is made of polyethylene.

16. An in-line roller skate according to claim 12, wherein:

said internal element is made of a closed-cell foam.

* * * * *